United States Patent [19]

Crosby et al.

[11] 4,177,993

[45] Dec. 11, 1979

[54] VARIABLE BLOCK PUZZLE AND CONTAINER

[76] Inventors: Bruce R. Crosby, 8650 Pitner #180, Houston, Tex. 77080; George Spector, 3615 Woolworth Bldg., 233 Broadway, New York, N.Y. 10007

[21] Appl. No.: 828,869

[22] Filed: Aug. 29, 1977

[51] Int. Cl.[2] ..... A63F 9/10

[52] U.S. Cl. ..... 273/160; 46/25

[58] Field of Search ..... 273/157 R, 160; 46/25, 46/16

[56] References Cited

U.S. PATENT DOCUMENTS

| | | | |
|---|---|---|---|
| 1,531,542 | 3/1925 | Cogshall | 273/157 R |
| 1,967,496 | 1/1935 | Springborn | 273/157 R |
| 2,472,363 | 6/1949 | Blackinton | 46/25 |
| 2,738,594 | 3/1956 | Swingle | 273/157 R X |
| 3,410,021 | 11/1968 | Patterson | 273/160 X |
| 3,637,217 | 1/1972 | Kent | 273/157 R |
| 3,672,681 | 6/1972 | Wolf | 273/157 R |
| 3,909,003 | 9/1975 | Rabinovich | 273/157 R |

*Primary Examiner*—Anton O. Oechsle

[57] ABSTRACT

A puzzle which can be manufactured in several different versions, each version including a box that is open on top and containing nine blocks that must interfit a specific way so to fit into the box, and a separately purchasable expansion kit of four additional blocks for use in substitution of four blocks in the original puzzle so to vary the puzzle solution; the purchases kit being sold also with a drawer in which the unused four blocks and the puzzle box can be neatly stored together.

2 Claims, 7 Drawing Figures

10
11
12
13
14
6
1
2
3
4
5
6
7
8
9
3A
4A
5A
8A 30
40
50
60
18
19
20
21
22
23
24

VARIABLE BLOCK PUZZLE AND CONTAINER

This invention relates generally to puzzles.

A principal object of the present invention is to provide a novel type of block puzzle which can be used in conjunction with a separately available expansion kit having a few different shaped blocks for replacing certain of the blocks in the puzzle so that a different solution can be made with the puzzle.

Another object is to provide a puzzle which can be made in different versions, and each version of the puzzle requires a specifically different expansion kit in order to convert the original puzzle into the different solution puzzle.

Other objects are to provide a variable block puzzle and container which is simple in design, inexpensive to manufacture, rugged in construction, easy to use and efficient in operation.

These and other objects will be readily evident upon a study of the following specification and the accompanying drawings wherein.

Figures 1, 2, 3, 4, 5, 6, 7:
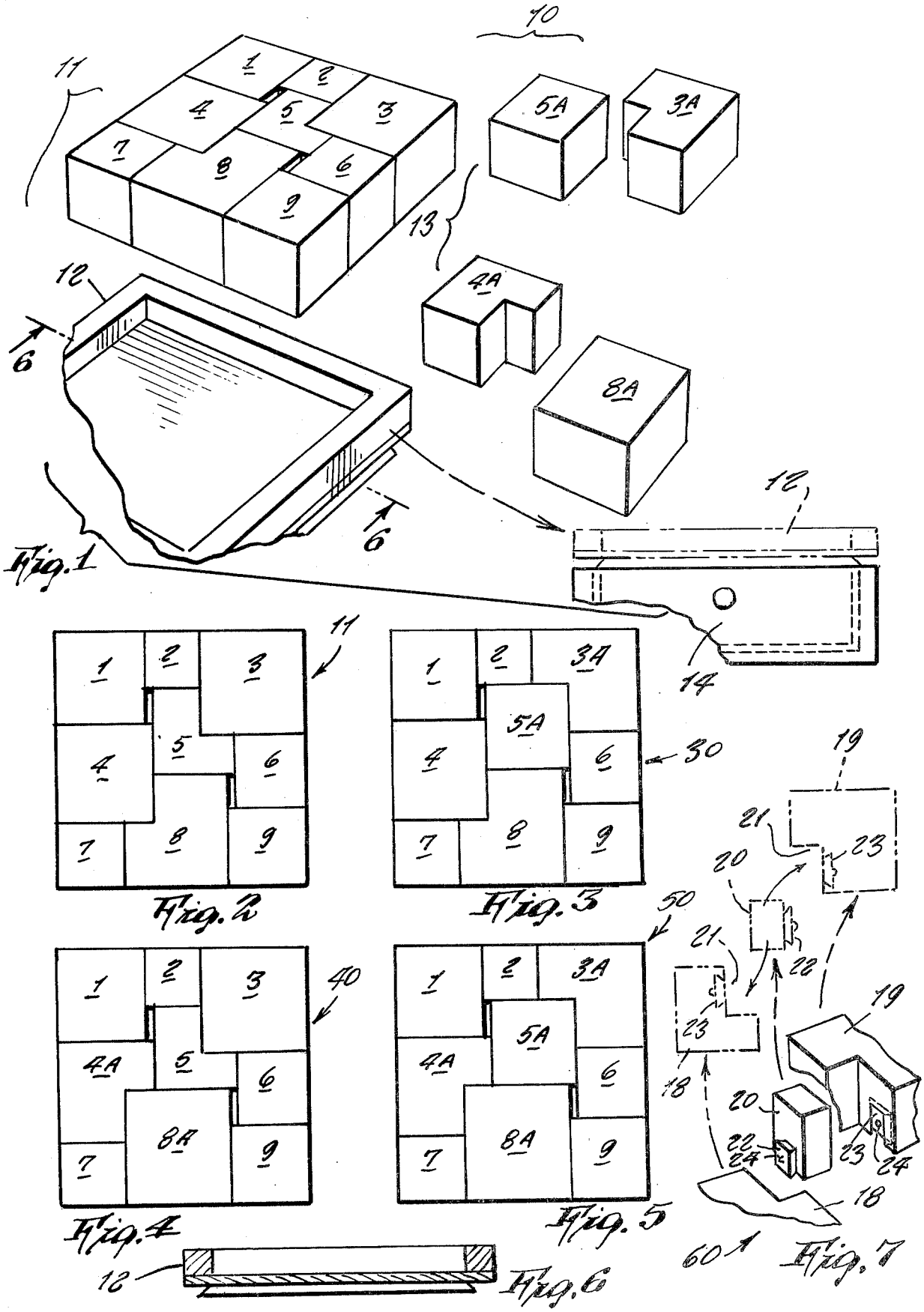
FIG. 1 is a perspective view of one version of the puzzle together with a expansion kit used therewith.
FIGS. 2, 3, 4 and 5 show different versions of the puzzle.
FIG. 6 is a side cross sectional view on line 6—6 of FIG. 1.
FIG. 7 shows an optional modified design of the invention in which the blocks are readily convertible into a different shape by a piece being attachable to either block, thus eliminating the necessity of extra expansion kits.

Referring now to the drawing in greater detail, and more particularly to FIGS. 1, 2 and 6 thereof at this time, the reference numeral 10 represents a variable block puzzle and container according to the present invention wherein there is an original puzzle 11 consisting of nine blocks (numbered from 1 to 9) and an open box 12 in which the blocks 1 to 9 will fit if the blocks are correctly interfitted together; it being noted that some of the blocks are cube shaped and others are irregularly shaped, and not all of the blocks are a same size. Thus it is challenging to interfit them properly together. However, once mastered a player will want to change the puzzle partly in order to again challenge her skill for attaining a solution. This is accomplished by purchase of an expansion kit 13 that consists of four blocks 3A, 5A, and 8A, and a drawer 14 for storing conveniently the components of the original puzzle together with the additional new four blocks.

To convert the puzzle by the conversion kit, the blocks 3, 5, 4 and 8 are removed and are replaced by the new four blocks. When thus converted and when properly solved to interfit, the nine blocks will fit properly into the box.

The invention may be manufactured in different versions as shown by puzzle 30 in FIG. 3, puzzle 40 in FIG. 4, and puzzle 50 in FIG. 5.

In order that a manufacturer need to make a minimum number of different blocks for the four versions 10, 30, 40 and 50 shown on the drawing, the expansion kit blocks 3A, 5A, 4A and 8A version 10 are used as the regular blocks in different of the other puzzles, as can be seen in FIGS. 3, 4 and 5. Thus:

| Version | | | Expansion Kit | | | Blocks |
|---|---|---|---|---|---|---|
| No. | 10 | uses | No. 13 | containing | Nos. | 3A, 5A, 4A, 8A |
| | 30 | " | 15 | " | | 3, 5, 4A, 8A |
| | 40 | " | 16 | " | | 3A, 5A, 4, 8 |
| | 50 | " | 17 | " | | 3, 5, 4, 8 |

Each expansion kit would include full instructions advising how to convert each puzzle to each of the other three versions.

All of the blocks in the puzzles and expansion kits are a same height. The top and bottom surfaces of each block are a same color and are different from a color of the sides of the blocks.

In FIG. 7, a modified version 60 of the invention shows a method whereby blocks of the puzzle are convertible by themselves so that no extra expansion kit with extra blocks is needed.

Thus in the example illustrated in FIG. 7, a puzzle of nine blocks includes among these the blocks 18 and 19 each of which is selectively convertible by having a block piece 20 attachable to either one of them as wished. Thus if the piece is not attached to one of the blocks, it must be attached to the other so that the two blocks interfit each other. Each block 18 and 19 has a notch 21 at one corner, the piece 20 fitting precisely into the corner so that the block is convertible from an L-shape or irregular shape into a square shaped block that interfits in the notch of the other block.

The piece 20 is attachable to either of blocks 18 and 19 by a wedge shaped projection 22 on the piece 20 being slide engaged in a wedge shaped slot 23 provided on each of the blocks. Thus attachment or detachment of the piece to either of the blocks is done quickly and easily. Detents 24 firmly hold the parts together.

Thus a modified design of the invention is provided.

While various changes may be made in the detail construction, it is understood that such changes will be within the spirit and scope of the present invention, as is defined by the appended claims.

The following is claimed:

1. A puzzle comprising a plurality of blocks with interfitting and abutting surfaces which when properly assembled form a rectangularly shaped assembly of predetermined dimension in combination with a container having a cavity of rectangular contour adapted to snugly receive the assembly thereon in further combination with means for varying the shapes of some of said blocks forming sub assemblies adapted to replace specific sub assemblies of said blocks to obtain the same said assembly of predetermined dimensions, wherein said container includes a compartment underlying said cavity for storing all of said blocks thereon, wherein, said means comprises additional blocks which replace certain blocks of different shape of the assembly, said additional blocks forming subassemblies similar to the replaced subassemblies.

2. A puzzle as in claim 1, wherein said means comprise blocks of adjustable shape each having a removable portion which can be removed from and secured to a plurality of blocks to form subassemblies of the same shape and dimension, wherein the said blocks of adjustable shape each being identical to the other blocks when said adjustable blocks include said portion.

* * * * *